US011660614B2

(12) United States Patent
Madsen

(10) Patent No.: US 11,660,614 B2
(45) Date of Patent: May 30, 2023

(54) HEAVY PHASE LIQUID DISCHARGE ELEMENT FOR A CENTRIFUGAL SEPARATOR, CENTRIFUGAL SEPARATOR AND METHOD FOR SEPARATING TWO LIQUID PHASES

(71) Applicant: ALFA LAVAL CORPORATE AB, Lund (SE)

(72) Inventor: Bent Madsen, Gentofte (DK)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 17/610,297

(22) PCT Filed: Apr. 29, 2020

(86) PCT No.: PCT/EP2020/061884
§ 371 (c)(1),
(2) Date: Nov. 10, 2021

(87) PCT Pub. No.: WO2020/229184
PCT Pub. Date: Nov. 19, 2020

(65) Prior Publication Data

US 2022/0212206 A1 Jul. 7, 2022

(30) Foreign Application Priority Data

May 16, 2019 (EP) ..... 19174947

(51) Int. Cl.
*B04B 11/02* (2006.01)
*B04B 1/20* (2006.01)
*B04B 7/08* (2006.01)

(52) U.S. Cl.
CPC ..... *B04B 11/02* (2013.01); *B04B 1/20* (2013.01); *B04B 7/08* (2013.01); *B04B 2001/2083* (2013.01)

(58) Field of Classification Search
CPC .. B04B 11/02; B04B 1/20; B04B 7/08; B04B 2001/2083
(Continued)

(56) References Cited

U.S. PATENT DOCUMENTS 2,614,748 A 10/1952 Ritsch
4,335,846 A * 6/1982 Shapiro ..... B04B 1/20 494/900
(Continued)

FOREIGN PATENT DOCUMENTS

CN 102271819 A 12/2011
CN 103189144 A 7/2013
(Continued)

OTHER PUBLICATIONS

International Search Report and Written Opinion dated Jul. 10, 2020 for Application No. PCT/EP2020/061884.
(Continued)

*Primary Examiner* — Shuyi S. Liu
(74) *Attorney, Agent, or Firm* — Patterson & Sheridan, LLP

(57) ABSTRACT

The present disclosure relates to a heavy phase liquid discharge element, a centrifugal separator comprising the element and to a method of separating two liquid phases. The heavy phase liquid discharge element comprises at least one inlet opening on a first side of the heavy phase liquid discharge element, the at least one inlet opening being adapted to face an interior of the centrifugal separator, and at least two separate outlet channels defining an outlet on the second side of the heavy phase liquid discharge element, wherein at least a portion of each of the outlet channels overlaps with the at least one inlet opening, thereby forming a liquid pathway between the at least one inlet opening and the outlet defined by the at least two outlet channels through
(Continued)

which the liquid can pass. By this design, pressure losses in the heavy phase liquid outlets can be decreased.

20 Claims, 9 Drawing Sheets

(58) Field of Classification Search
USPC ..... 494/2, 3, 56
See application file for complete search history.

(56) References Cited

U.S. PATENT DOCUMENTS

| | | | |
|---|---|---|---|
| 9,028,387 | B2 | 5/2015 | Eiken |
| 9,352,338 | B2 | 5/2016 | Reiff et al. |

FOREIGN PATENT DOCUMENTS

| | | | |
|---|---|---|---|
| CN | 205868566 | U | 1/2017 |
| EP | 2551021 | A1 | 1/2013 |
| FR | 2123213 | A1 | 9/1972 |
| WO | 2008138345 | A1 | 11/2008 |
| WO | 2009127212 | A1 | 10/2009 |
| WO | 2010019418 | A2 | 2/2010 |
| WO | 2010019418 | A3 | 2/2010 |
| WO | 2012062337 | A2 | 5/2012 |

OTHER PUBLICATIONS

Chinese Office Action dated Apr. 20, 2022 for Application No. 202080051246.5.

* cited by examiner

X-X

HEAVY PHASE LIQUID DISCHARGE ELEMENT FOR A CENTRIFUGAL SEPARATOR, CENTRIFUGAL SEPARATOR AND METHOD FOR SEPARATING TWO LIQUID PHASES

TECHNICAL FIELD

The present disclosure relates to a heavy phase liquid discharge element, a centrifugal separator configured to separate a first liquid phase, a second liquid phase and a solid phase from a slurry, wherein the liquid phases have different densities and a method of separating a first liquid phase and a second liquid phase from a slurry by means of centrifugal forces in a centrifugal separator, as defined in the appended claims.

BACKGROUND ART

In the processing industry where different slurries are handled, there may be a need to separate solids from liquids at some point during a manufacturing process. For this purpose, a decanter centrifuge may be used. Such decanter centrifuge utilizes centrifugal forces, whereby liquids can be separated from solids. The liquids may comprise one or two phases, i.e. the liquids have different densities. When the slurry is subjected to the centrifugal forces, the denser solid particles are pressed outwards against a rotating bowl wall, while the less dense liquid phase forms a concentric inner layer. Different dam plates, also referred to as weir edges, are used to vary the depth of the liquid, so called pond. The sediment formed by the solids is continuously removed by means of a screw conveyor arranged with the bowl of the decanter centrifuge. The screw conveyor is usually arranged to rotate at a different speed than the bowl, whereby the solids can be gradually removed from the bowl. Thus, the centrifugal forces compact the solids and expel the surplus liquid. The clarified liquid phase or phases overflow the dam plates situated at an end opposite to the solids removal end of the bowl. Baffles within the centrifuge casing direct the separated liquid phases into correct flow paths and prevent risk of cross-contamination.

Reference is made to FIG. 1, which shows a prior art centrifugal separator or decanter centrifuge schematically. For example WO2008138345 discloses a centrifugal separator of this type. The centrifugal separator comprises a rotating body 1 comprising a bowl 2 and a screw conveyor 3 which are mounted on a shaft 4 such that they in use can be brought to rotate around a horizontal axis 5 of rotation. The axis 5 of rotation extends in a longitudinal direction of the bowl 2. Further, the rotating body 1 has a radial direction 5*a* extending perpendicular to the longitudinal direction. For the sake of simplicity directions "up" and "down" are used herein as referring to a radial direction towards the axis 5 of rotation and away from the axis 5 of rotation, respectively. The bowl 2 comprises a base plate 6 provided at one longitudinal end of the bowl 2, which base plate 6 has an internal side 7 and an external side 8. The base plate 6 is provided with a number of liquid phase outlet passages 9 having external openings in the external side 8 of the base plate. Furthermore the bowl 2 is at an end opposite to the base plate 6 provided with solid phase discharge openings 10. The screw conveyor 3 comprises inlet openings 11 for feeding a feed slurry to the rotating body 1. The slurry comprises a light, liquid phase 12 and a heavy, solid phase 13. During rotation of the rotating body 1, separation of the liquid phase 12 and solid phase 13 are obtained. The liquid phase 12 is located radially closer to the rotation axis than the heavier solid phase 13, and the liquid phase is discharged through the outlet passages 9 in the base plate 6, while the screw conveyor 3 transports the solid phase 13 towards the solid phase discharge openings 10 through which the solid phase 13 is eventually discharged. Each liquid phase outlet passage 9 may be partly covered by a weir or dam plate 14, as shown in FIG. 1. The weir plate 14 determines a level 15 of the liquid in the bowl.

Furthermore, centrifugal separators adapted for separation of two liquid phases are known for example from WO2009127212. Reference is made to FIG. 2*a*, which shows an example of a prior art centrifugal separator or decanter centrifuge schematically, which is adapted to separating two liquid phases, but the solid phase separation works in a similar way as in FIG. 1. The centrifugal separator comprises a rotating body 1' comprising a bowl 2' and a screw conveyor 3' which are mounted on a shaft 4' such that they in use can be brought to rotate around a horizontal axis 5' of rotation. The axis 5' of rotation extends in a longitudinal direction of the bowl 2'. Further, the rotating body 1' has a radial direction 5*a'* extending perpendicular to the longitudinal direction. The bowl 2' comprises a base plate 6' provided at one longitudinal end of the bowl 2', which base plate 6' has an internal side 7' and an external side 8'. The base plate 6' is provided with a number of heavy liquid phase outlet passages 19' and a number of light liquid phase outlet passages 19". Furthermore the bowl is at an end opposite to the base plate provided with solid phase discharge openings (not shown) in a similar manner as in the variant shown in FIG. 1. As in FIG. 1, the screw conveyor 3' comprises inlet openings (not shown) for feeding a feed slurry to the rotating body 1'. The slurry comprises a solid phase (not shown), light liquid phase 21' and a heavy liquid phase 22'. During rotation of the rotating body 1', separation of the liquid phases 21' and 22' and the solids are obtained. The light liquid phase 21' is located radially closer to the rotation axis 5' than the heavier liquid phase 22'. The light liquid phase 21' is discharged through the outlet passages 19" in the base plate 6 to an outlet chamber 20", the heavy liquid phase 22' is discharged through outlet passages 19' to an outlet chamber 20', while the screw conveyor 3' transports the solid phase towards the solid phase discharge openings at the opposite end of the separator as described in connection with FIG. 1. Each liquid phase outlet passage 19' and 19" is partly covered by a respective heavy phase weir and dam plate 14' and a light phase weir plate 14". The respective weir plates 14' and 14" determine a respective heavy phase level 15' and a light phase level 15" in the bowl, whereby it is possible to discharge respective liquid phases.

Liquid discharge elements have been incorporated in base plates of centrifugal separators, which include outlet housings, also called "power tubes". WO 2012/062337 shows an example of such centrifugal separator, in which an outlet housing is arranged in fluid connection with an outlet passage which extends through the base plate. The outlet housing receives liquid from the bowl of the rotating body via the outlet passage and has an outlet opening discharging liquid from the outlet housing. The outlet opening comprises a weir edge defining in normal use a level of a surface of the liquid in the bowl. The outlet housing may be rotatable around an adjustment axis and the outlet opening is placed in a side wall of the housing, offset from the adjustment axis. In this document, two different types of channel members or liquid discharge elements are arranged for the respective two different liquid phases. The liquid channel members are in turn connected to a respective type of outlet housing, which are arranged to discharge liquid phases to a respective liquid compartment. In the arrangement, when adjusting the angular position of the outlet housings, care is taken that an outlet opening in the housing faces rearwards relative to a direction of rotation in order to discharge the liquid phase in an opposite direction relative to the direction of rotation. Thereby, energy can be recovered from the discharged liquid.

Thus, it is previously known how to separate liquids from solids and two liquid phases from each other by means of centrifugal separators. However, especially in connection with separation of two liquid phases, it has been noted that outlet passages for heavy phase liquids may suffer from a drawback of rendering pressure losses during discharge. Therefore, there is still a need to further improve the centrifugal separators.

SUMMARY OF THE INVENTION

The pressure losses mentioned above may affect the separation process of two liquids in different ways. It has been noted for example that the pressure losses may lead to losses of the light phase during the separation. This may be due to the fact that heavy phase cannot be discharged at the same rate as the light phase, whereby a position of an interface, i.e. a level between the two liquid phases, becomes unstable. Thus, the level settings in the outlet arrangement may not correspond to the actual interface level position, which is unstable.

It is thus an objective of the present invention to provide an outlet passage with reduced pressure loss for the heavy phase in centrifugal separators. It is especially an objective to reduce pressure losses in outlet arrangements including channel members or liquid discharge elements which are incorporated in base plates to provide liquid outlet passages connected to outlet housings.

It is a further objective to provide more stable interface position even in case of large flow variations.

The objectives above are attained by a heavy phase liquid discharge element, a centrifugal separator and a method for separating a first liquid phase and second liquid phase as defined in the appended claims. Accordingly, the present invention relates to a heavy phase liquid discharge element for a centrifugal separator, which is configured to separate two liquid phases having different densities. The heavy phase liquid discharge element has a longitudinal extension, a transversal extension perpendicular to the longitudinal extension, a first inlet side and an opposite second outlet side, both extending in the longitudinal direction and in the transversal direction, a first longitudinal portion comprising a first transversally extending edge, a second longitudinal portion comprising a second transversally extending edge, and two longitudinally extending side edges, in between which a longitudinally extending center line extends The heavy phase liquid discharge element comprises at least one inlet opening on the first side of the heavy phase liquid discharge element. The at least one inlet opening being is adapted to face an interior of the centrifugal separator. Further, the heavy phase liquid discharge element comprises at least two separate outlet channels defining an outlet on the second side of the heavy phase liquid discharge element. At least a portion of each of the outlet channels overlaps with the at least one inlet opening, thereby forming a liquid pathway between the at least one inlet opening and the outlet defined by the at least two outlet channels through which the liquid can pass. Additionally, each of the at least two outlet channels has an extension in the longitudinal direction of the heavy phase liquid discharge element, which is longer than the extension of the at least one inlet opening in the longitudinal direction.

By providing at least two outlet channels, the tangential dimension of the outlet channel is reduced by introducing at least two separate outlet channels. It has been surprisingly noted that in this way pressure losses can be limited substantially, since the vortices in the radial movement will be reduced. This is a huge advantage, since the separation process in the centrifugal separator thus becomes less sensitive to flow rate variations and the interface between the light and heavy liquid phases becomes more stable.

The at least two outlet channels may be arranged in parallel along the longitudinal extension of the heavy phase liquid discharge element. The at least two outlet channels may be positioned symmetrically and mirror-imaged in respect to the center line. In this way the flow of the liquid may be equal in the channels.

The at least two outlet channels may extend in the first and second longitudinal portions (I; II). The number of the outlet channels may be from 2 to 6. Thus, the liquid may be pressed in the channels radially inwards, while the pressure losses may be further reduced.

The two outlet channels may have respective channel end portions which taper symmetrically and in a mirror-imaged way towards the center line and the second transversal edge in the second longitudinal portion and wherein the tapering end portions may have a rounded shape. In this way, the channels may better adapt to a shape of an outlet housing.

The at least one inlet opening may be comprised in the first longitudinal portion. In this way, it is possible to place the intake of the liquid close to the bowl wall, when mounted in a separator.

The amount of the inlet openings may correspond to the amount of the outlet channels. In this way, the pressure losses may be further reduced.

The at least one inlet opening may comprise a first transversally extending inlet edge on the first inlet side towards the first transversal edge of the liquid discharge element. Each of the outlet channels comprises a first transversally extending outlet edge on the second outlet side towards the first transversal edge of the liquid discharge element. A longitudinal distance between the first transversal inlet edge and the first transversal edge of the liquid discharge element is smaller than a longitudinal distance between the first transversally extending outlet edge and the first transversal edge of the liquid discharge element. In this way a peripheral wall for the inlet opening can be provided. Additionally, an extension of the first transversal inlet edge in a plane of a thickness dimension may be perpendicular to the central line and to a peripheral wall. The perpendicular extension and/or the peripheral wall may in mounted position reduce suck up of particles from the area close to the bowl wall.

The present disclosure also relates to a centrifugal separator configured to separate a first liquid phase, a second liquid phase and a solid phase from a slurry, wherein the liquid phases have different densities providing the same advantages as described above. The centrifugal separator comprises a rotating body comprising a bowl, which comprises a base plate at an end of the bowl. The base plate has an inner surface and an opposite outer surface and the inner surface faces an interior of the bowl. The base plate comprises one or more first liquid phase outlet passages and one or more second liquid phase outlet passages. The first and second liquid phase outlet passages are configured to discharge liquid from the rotating body. The second liquid phase outlet passages are associated with the heavy phase liquid discharge element as defined above.

The one or more first liquid phase outlet passages may be configured to discharge the first liquid phase, which is lighter than the second liquid phase. Thus, different outlets can be used for different liquid phases.

The one or more first liquid phase outlet passages may comprise a light phase liquid discharge element comprising an opening passage in fluid connection with the first outlet passage comprised in the base plate. Thus, by having liquid discharge elements for both light and heavy phase, rotational symmetry may be obtained.

The light phase liquid discharge elements and the heavy phase liquid discharge elements may be arranged in association with the inner surface of the base and at different angular positions relative to the axis of rotation. The amount of the light phase liquid discharge element and the heavy phase liquid discharge element may vary from 2 to 16. The amount may be equal. Alternatively, the amount of the heavy phase liquid discharge elements may be larger or smaller than the amount of the light phase liquid discharge element. Thus, in this way it is possible to adapt the separator to the slurry to be separated.

The light phase liquid discharge element and the heavy phase liquid discharge element may be associated with a respective outlet housing. Each of the outlet housings may be rotatably adjustable around an adjustment axis, and each of the outlet housings may comprise a respective outlet opening comprising a respective weir edge. The outlet housings may enable energy recovery from the liquid.

Furthermore, the present invention relates to a method of separating a first liquid phase and a second liquid phase from a slurry by means of centrifugal forces in a centrifugal separator. The liquid phases have different densities and the method comprising steps of

- bringing the slurry to a rotational movement in a cylindrical bowl and thereby separating the slurry into two liquid phases,
- separating the liquid phases from each other by
  - bringing the first light liquid phase in fluid contact with at least one first outlet passage comprised in a base plate of the centrifugal separator, the first outlet passage being connected to a weir plate adapted for keeping at least part of the second, heavy phase inside the rotating bowl, wherein the at least one outlet passage provides a liquid pathway to the light phase to be discharged from the bowl
  - bringing the second heavy phase in contact with at least one second outlet passage comprised in a base plate of the centrifugal separator comprising a heavy phase liquid discharge element being adapted for keeping the first light phase inside the rotating bowl and for providing a liquid pathway to the heavy phase to be discharged from the bowl, wherein the method is characterized by discharging the heavy phase by using at least two separate liquid outlet channels connected to a respective at least one second outlet passage.

Further features and advantages of the present invention are disclosed in the detailed description below.

DETAILED DESCRIPTION

Thus, according to the present disclosure the pressure losses in an outlet passage for a heavy phase liquid can be reduced by using a heavy phase liquid discharge element as described more in detail herein. The heavy phase liquid discharge element is especially usable for a centrifugal separator configured to separate two liquid phases having different densities.

Figure 3A:
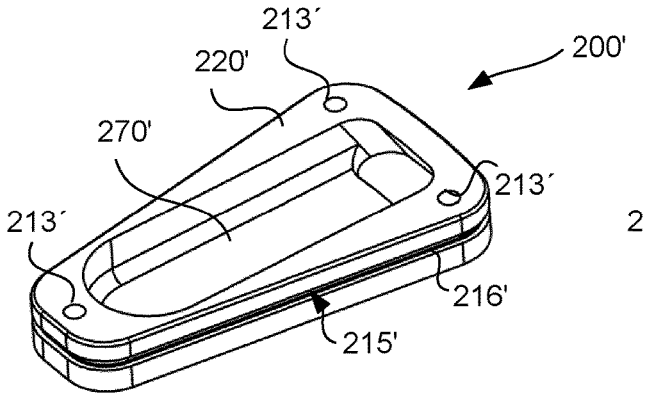
FIG. 3*a* shows a perspective view of a prior art liquid discharge element from a second surface comprising an outlet channel.
Figure 3B:
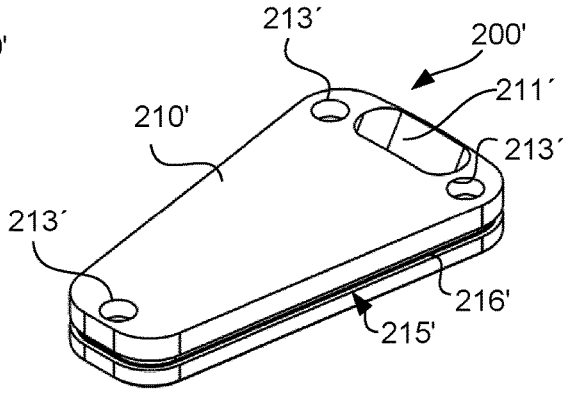
Fig. 3b PRIOR ART
FIG. 3*b* shows the liquid discharge element of FIG. 3*a* from a first surface comprising an inlet opening.
Figure 4A:
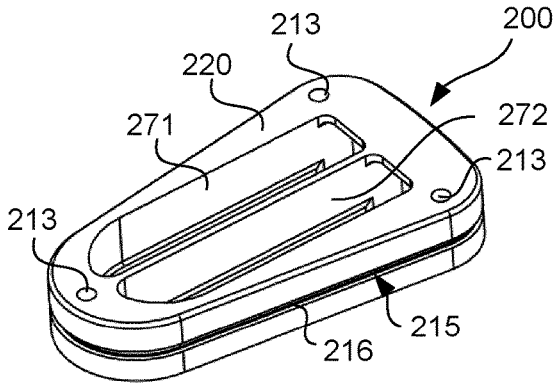
FIG. 4*a* shows a perspective view of a liquid discharge element according to the present disclosure from a second surface comprising two outlet channels.
Figure 4B:
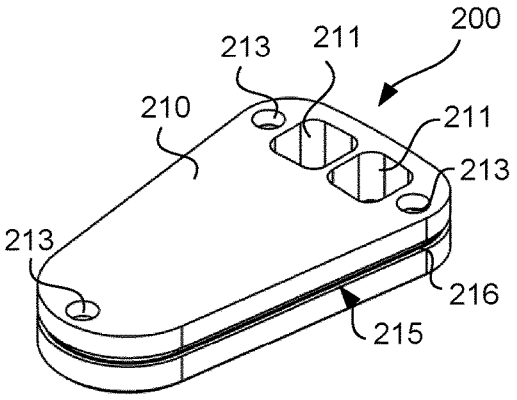
FIG. 4*b* shows the liquid discharge element of FIG. 4*a* from a first surface comprising two inlet openings.

An example of the heavy phase liquid discharge element 200' according to a prior art solution is shown in FIGS. 3*a* and 3*b* in a perspective view. An example embodiment of the heavy phase liquid discharge element 200 according to the present invention is shown in FIGS. 4*a* and 4*b* in a similar perspective view as the prior art heavy phase liquid discharge element of FIGS. 3*a* and 3*b*. The heavy phase liquid discharge element 200' 200 is herein below also referred to as "the element 200', 200".

FIGS. 3*a* and 4*a* view a second, outlet, side 220', 220 of the elements 200' and 200 that is adapted to face an external side of the centrifugal separator. The details of the element 200 are described more in detail below, but as can be seen, the liquid charge element 200 according to the present disclosure comprises at least two separate outlet channels 271; 272 defining at least one outlet opening on the second side 220 of the heavy phase liquid discharge element 200. The prior art liquid charge element 200' comprises only one outlet channel 270'. Additionally, a view of a first, inlet, side 210' and 210 of the respective elements 200' and 200 is illustrated in FIGS. 3*b* and 4*b*. As illustrated, the liquid discharge element 200 according to the present disclosure comprises two separate inlets 211; 212 on the first side 210 of the heavy phase liquid discharge element 200. The prior art liquid charge element 200' comprises one inlet opening 211'. Further the prior art liquid charge element 200' comprises holes 213' for attachment means, such as a screw. It can also be seen that in both the prior art liquid charge element 200', and in the present liquid charge element 200, in between the outlet side 220', 220 and the inlet side 210', 210, around the periphery of the respective element 200', 200, a track 215', 215 is arranged. In the track, a sealing means 216', 216, for example an elastic O-ring, is arranged to prevent liquid leakage.

Figures 5A, 5B, 5C:
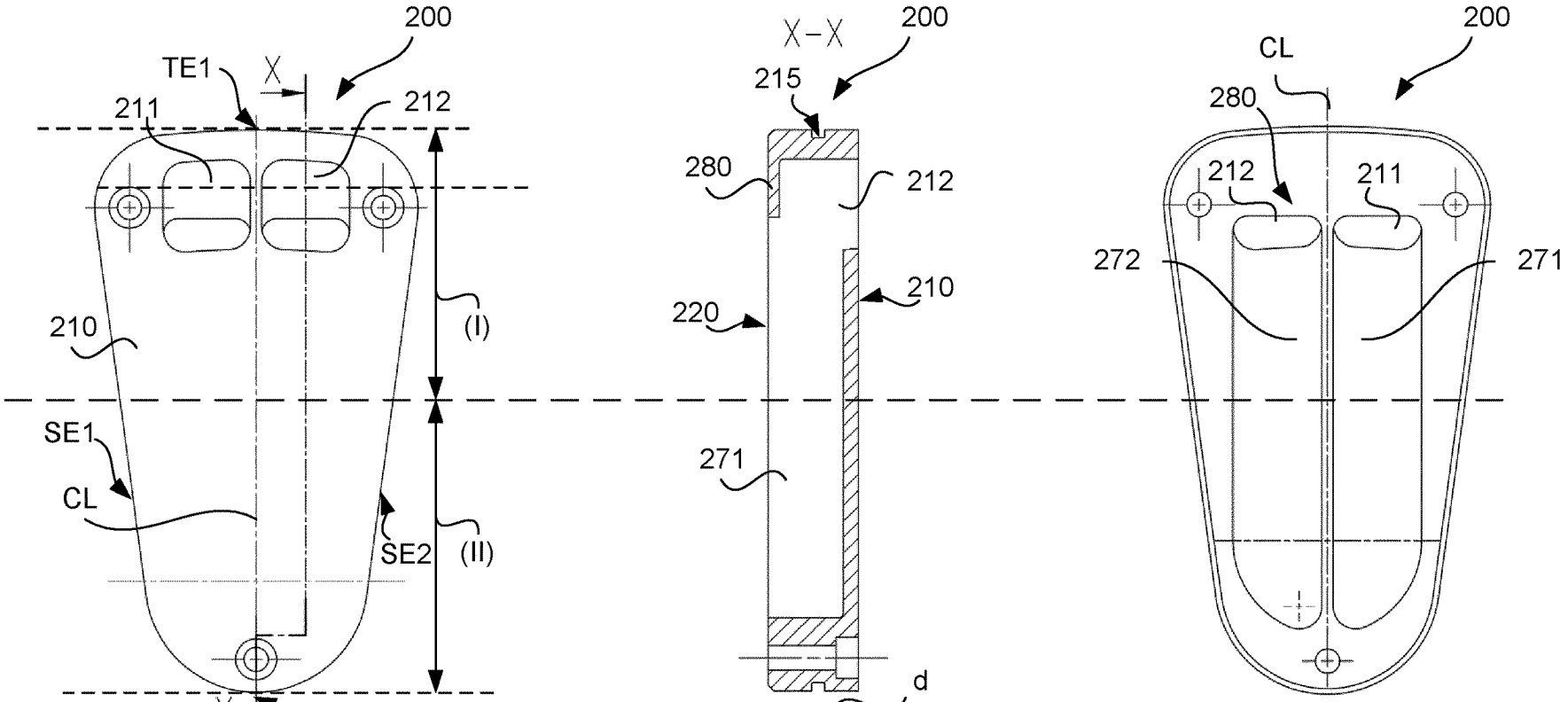
FIG. 5*a* shows a view from a first surface of a liquid discharge element comprising two inlets, according to the present disclosure.
FIG. 5*b* shows a cut side view along the line X-X of the liquid discharge element shown in FIG. 5*a*
FIG. 5*c* shows a view of the liquid discharge element of FIGS. 5*a* and 5*b* from a second surface of the liquid discharge element comprising two outlet channels.

The shape and structure of the heavy phase liquid discharge element 200, referred to as "the element 200" below, is shown in more detail in FIGS. 5*a*, 5*b* and 5*c*. FIG. 5*a* shows that the element 200, which in the illustrated example is a plate having a shape resembling a triangle with rounded corners, has a longitudinal extension L and a transversal extension T, which is perpendicular to the longitudinal extension. Any other outer shape could be utilized for the heavy phase liquid discharge element 200, referred to as "the element 200", e.g. rectangular, elliptical or circular. By having the slightly triangular shape, it is possible to utilize only three mounting screws. The rounded corners have an advantage of facilitating the placement of the sealing means in between the inlet and outlet sides, while preventing wear and tear of the sealing means against sharp edges.

The maximal longitudinal extension, i.e. the length, and the transversal extension, i.e. the width, of the element 200 can vary depending on the application. The maximal longitudinal extension corresponds extension in a radial direction, when the element is mounted on the base. The maximal longitudinal and transversal extensions can be adapted to the diameter of the bowl and the base thereof. For example, a ratio longitudinal extension of the element to the bowl diameter may be from 1:10 to 1:2.5, such as 1:3, but is not limited thereto. A ratio transversal extension of the element 200 to the longitudinal extension of the element 1:3 to 1:1.1, such as 1:1.5, but is not limited thereto. However, the longitudinal extension is suitably longer than the transversal extension so that outlet channels may be provided with sufficient length in relation to the width of the channels, whereby the pressure losses of the heavy phase can be minimized.

The element 200 comprises a first longitudinal portion (I) comprising a first transversally extending edge TE1, which is illustrated as an upper edge in FIG. 5*a*-5*c*. The element 200 also comprises a second longitudinal portion (II) comprising a second transversally extending edge TE2. The first longitudinal portion (I) transitions to the second longitudinal portion (II), and vice versa, at a point corresponding to half of the maximal length of the element 200 along the longitudinal extension. For example, if the maximal length of the element 200 is 130 mm from the transversally extending edge to edge, the first longitudinal portion (I) transitions to the second longitudinal portion at a transversal line drawn through a position corresponding to 65 mm from edge to edge.

The element 200 further comprises a center line (CL), which extends centrally in between two longitudinally extending side edges SE1 and SE2. The center line (CL) extends longitudinally through a point corresponding to half of the maximal width of the element 200. Thus, the centre line (CL) may divide the element 200 into two symmetrical, but mirror-imaged, portions. The centre line may be in a mounted position be arranged in the direction of the radius of the base plate.

The element further comprises a first inlet side 210, or inlet side surface, and an opposite, second outlet side 220, or an outlet side surface, both extending in the longitudinal direction and in the transversal direction. At least one inlet opening 211 is arranged on the first side 210 of the heavy phase liquid discharge element. The at least one inlet opening is adapted to face an interior of the centrifugal separator, when installed in the centrifugal separator, and as described more in detail below. In the illustrated example of FIG. 4*b*, there are two inlet openings depicted with numerals 211 and 212, respectively. According to a variant, the amount of the inlet openings may correspond to the amount of outlet channels, whereby the interface will be more stable even in case of large flow variations. Thus, in case of two outlet channels, there may be two inlet openings, etc.

According to the present invention, the element 200 comprises at least two separate outlet channels 271; 272 defining an outlet on the second side 220 of the element 200. The outlet channels 271 and 272 are arranged in parallel along the longitudinal extension of the element 200. Generally, the amount of the outlet channels may be more than two, for example 2-6 or 2 to 4, and can be adapted to the application in question. Further the liquid charge element 200 comprises holes 213 for attachment means, such as a screw.

The maximal width of each channel, i.e. extension in the transversal direction of the element 200, may vary, but may be generally less than about ⅓ of the maximal transversal extension of the element 200, for example up to about 30%, 25% or 20% or 15% of the maximal transversal extension of the element 200. The lower limit for the width depends on the liquid in question, but should be adapted so that the channel width is not too narrow and thereby does not negatively affect the flow through the element 200. Each of the channels may thus have a maximum width of for example less than about 35 mm, for example from 10 to 30 mm, but is not limited thereto.

The at least two channels may be arranged in a parallel manner on the second, outlet side 220 of the element 200. However, the length of the individual channels may vary so that the channels can adapt to an outer shape of the element. At the same time the flow in the separation process should not be negatively affected by the length of the channels. Generally it is advantageous that the at least two outlet channels 271, 272 are positioned symmetrically and mirror-imaged in respect to the center line CL. However, at least a portion of each of the outlet channels 271 and 272 overlaps with the at least one inlet opening 211, 212. Thereby, a liquid pathway between the at least one inlet opening and the at least one outlet defined by the at least two outlet channels through which the liquid can pass, is formed. Furthermore, each of the at least two outlet channels 271, 272 has an extension in the longitudinal direction, i.e. the length, which is longer than the extension of the at least one inlet opening in the longitudinal direction. Suitably, the at least two outlet channels 271; 272 extend in the first (I) and second (II) longitudinal portions. The at least one inlet opening 211, 212 may be comprised in the first longitudinal portion (I). Thereby, the outlet channels may be substantially longer, such as 3-5 times longer than the inlet openings. Thus, the heavy phase liquid can be effectively pressed in a radial direction during the discharge of the liquid.

The purpose of the outlet channel/channels is to press the heavy phase liquid, which enters a liquid passage at a radial position near an inner wall of a bowl of a centrifugal separator radially inward towards a rotating axis of the centrifugal separator. Coriolis forces will create turbulence and vortices in the radial movement, which is one of the reasons for the generation of pressure losses. By reducing the tangential dimension of the outlet channel by introducing at least two separate outlet channels, it has been surprisingly noted that the pressure losses can be limited substantially, since the vortices in the radial movement will be reduced. This is a huge advantage, since the separation process in the centrifugal separator thus becomes less sensitive to flow rate variations and the interface between the light and heavy liquid phases becomes more stable. Therefore, e.g. light phase liquid (e.g. an oil) losses can be decreased.

Figure 6:
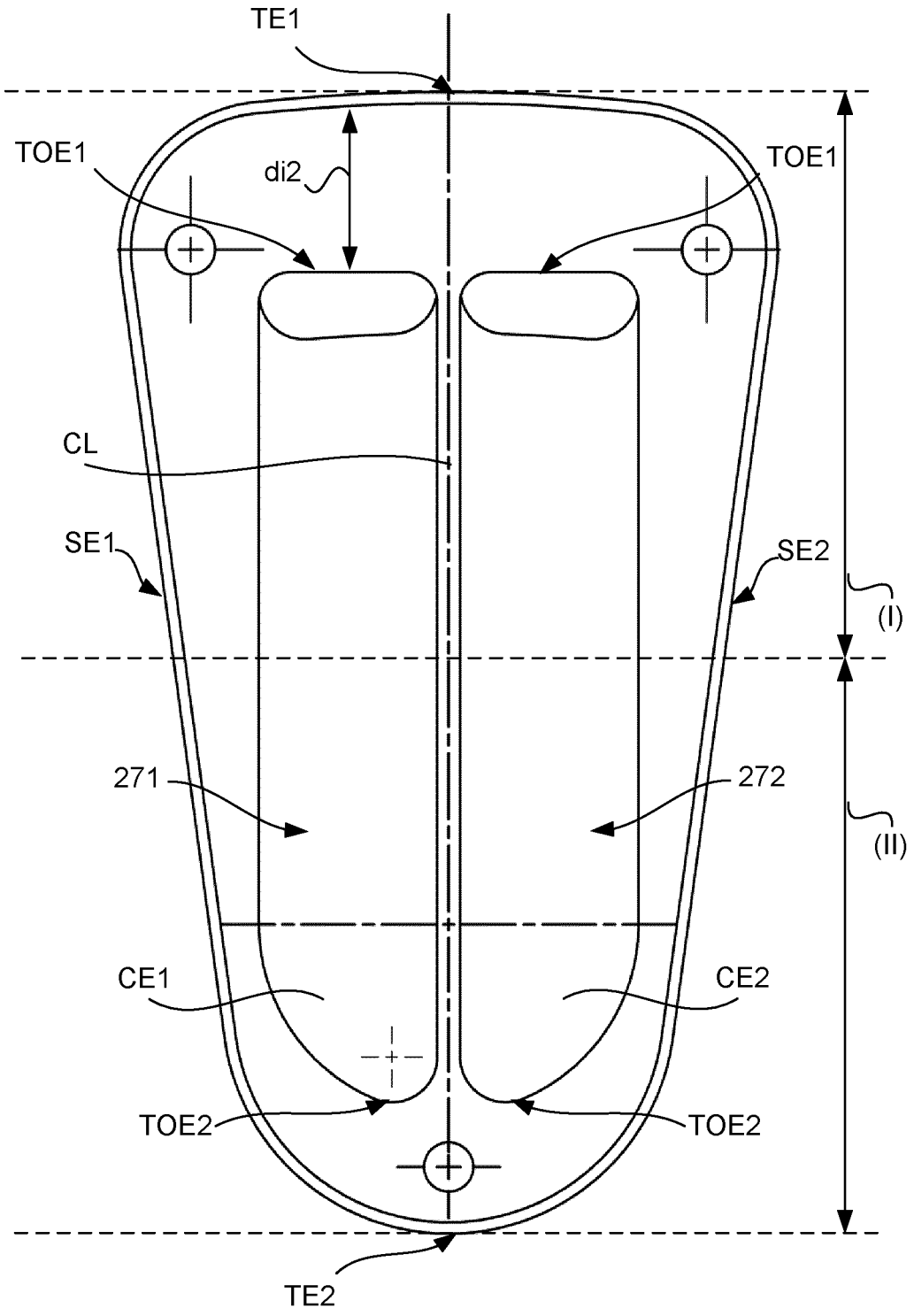
FIG. 6 shows an enlarged view of FIG. 5*c;*
Figure 7:
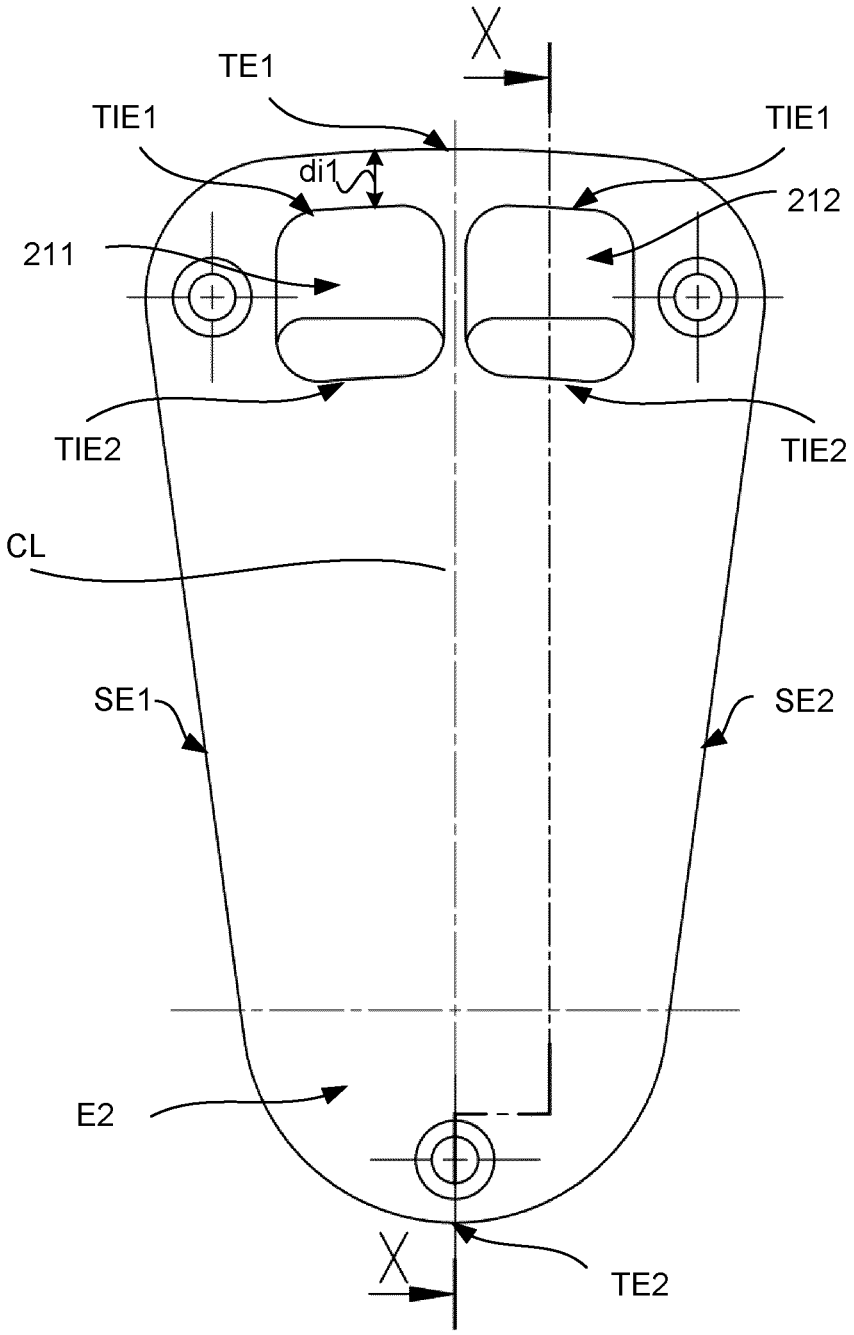
FIG. 7 shows an enlarged view of FIG. 5*a;*

Reference is now made to FIG. 6 and FIG. 7. FIG. 6 shows the element 200 in an enlarged view from the second, outlet, side 220. FIG. 7 shows the element 200 in an enlarged view from the first, inlet, side 210. The FIG. 6 shows that the two outlet channels 271; 272 may have respective channel end portions CE1 and CE2 which taper symmetrically and in a mirror-imaged way towards the center line CL and the second transversal edge TE2 in the second longitudinal portion (II) of the element. Each of the outlet channels 271 and 272 also comprises a first transversally extending outlet edge TOE1 and a second transversally extending outlet edge TOE2, which may provide a point of longest extension in the longitudinal direction towards the second transversal edge of the element. The tapering end portions CE1 and CE2 have a rounded shape, approximately resembling a quarter of an ellipse or a circle. In case of several channels, the described shape of channel end portions CE1 and CE2 could be provided for the channels locating closest to the side edges SE1 and SE2. The shape can then better adapt to a circular peripheral shape of an outlet housing, also referred to as a power tube, which may be in close proximity or connected to the element 200, as explained more in detail below.

FIG. 6 further shows that each of the outlet channels 271, 272 comprises a first transversally extending outlet edge TOE1 on the second outlet side 220 and towards the first transversal edge TE1 of the liquid discharge element 200. The first transversally extending outlet edge TOE1 has a longitudinally extending distance dig to the first transversal edge TE1 of the heavy phase liquid discharge element 200. Each of the channels also comprises a second transversally extending outlet edge TOE2, which is opposite to the first transversally extending outlet edge TOE1.

FIG. 7 shows in a corresponding manner that each of the at least one inlet openings 211, 212 comprises a first transversally extending inlet edge TIE1 on the first inlet side 210 and towards the first transversal edge TE1 of the liquid discharge element 200. Each of the inlet openings also comprises a second transversally extending inlet edge TIE2, opposite to the first transversally extending inlet edge TIE1. The first transversally extending inlet edge TIE1 has a longitudinally extending distance di1 to the first transversal edge TE1 of the heavy phase liquid discharge element 200.

As can be seen, the longitudinal distance di1 between the first transversal inlet edge TIE1 and the first transversal edge TE1 of the liquid discharge element 200 is smaller than the longitudinal distance di2 between the first transversally extending outlet edge TOE1 and the first transversal edge TE1 of the liquid discharge element 200. In this way, the inlet opening edges can be arranged closer to the first edge of the element 200 than the outlet channel edges. Thus, as displayed in FIGS. 5*b* and 5*c*, a peripheral wall portion 280 can be provided in connection with the inlet openings 211, 212. The peripheral wall 280 assists in pressing the liquid downwards along the extension of the channels towards the second transversal edge TE2. In this way, the total length of the liquid pathway can be maximized, and thus the pressure losses can be further decreased. Also, as shown best by FIG. 5*b*, an extension of the first transversal inlet edge TIE1 in a plane of a thickness dimension (d) of the element 200 is perpendicular to the central line, and also perpendicular to the peripheral wall 280. Thereby suck up of particulate material, which may be drawn with the liquid when pressing it radially inwards from the location near the bowl wall through the liquid pathway between the inlet openings and the two outlet channels, can be decreased. Additionally, the stability of the interface position can be further improved.

As shown by the FIGS. 5*a*, 5*c*, 6 and 7, the side edges SE1 and SE2 may taper symmetrically, and mirror-imaged from the first longitudinal portion towards the center line (CL) and the second transversal edge (TE2). The tapering angle in respect of the extension of the center line (CL) may vary, but could be from 5-15 degrees and/or could correspond to the circumferential angle depending on the distance to a center of a base plate, in which the element 200 is mounted. FIG. 7 further shows that the second longitudinal portion (II) of the liquid discharge element 200 may comprise a second end portion E2, which is semi-circular or has a shape of a circular segment. Thus, a shape resembling a triangle with rounded corners may be provided. Such shape enables attachment of the element to the bowl by means of three attachment means, such as screws.

The present invention also relates to a centrifugal separator or decanter centrifuge configured to separate a first liquid phase, a second liquid phase and a solid phase from a slurry.

Figure 8A:
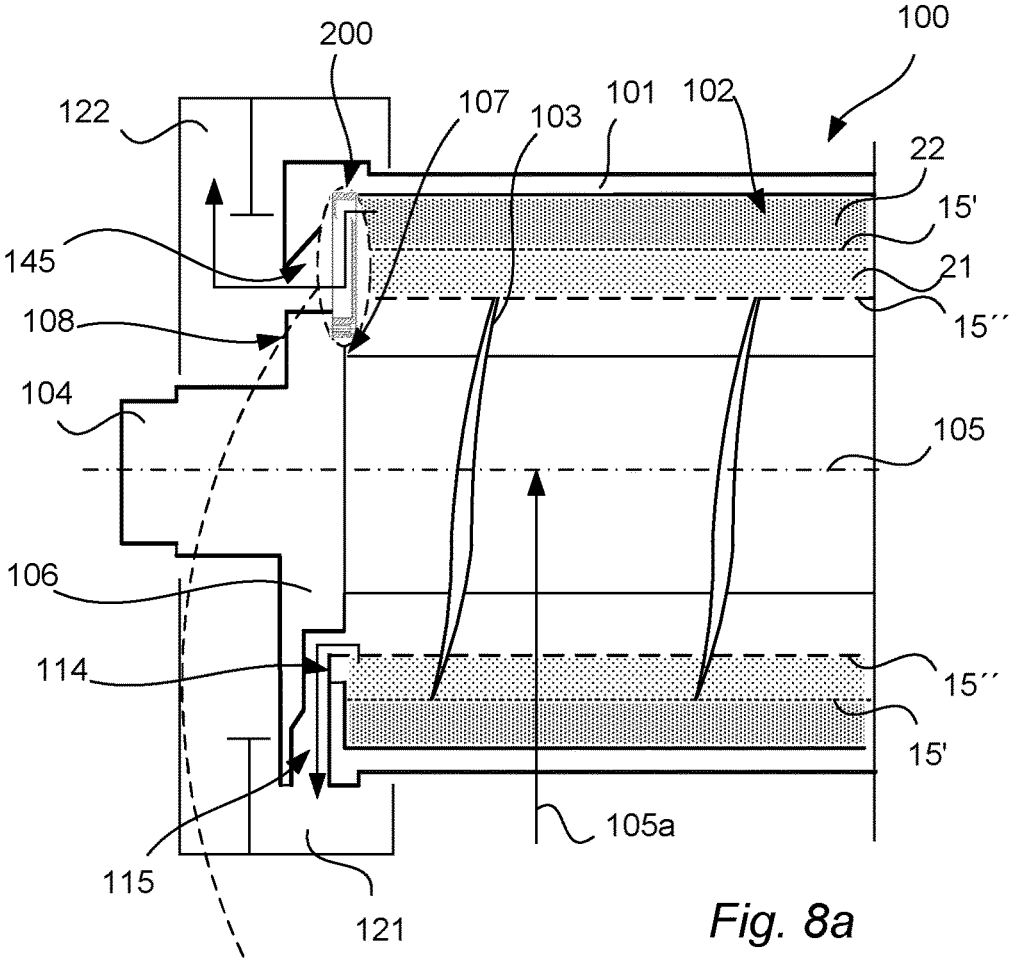
FIG. 8*a* shows schematically a partially cut view of an example centrifugal separator according to the present disclosure.
Figure 8B:
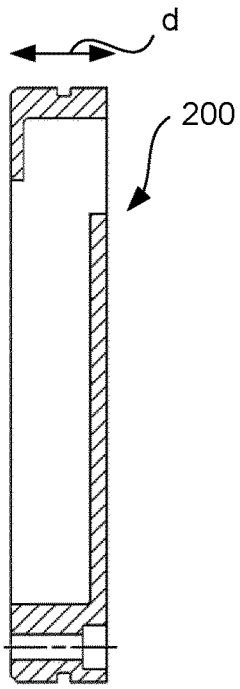
FIG. 8*b* shows an enlarged view of a portion of FIG. 8*a* corresponding to FIG. 5*b;*

Reference is now made to FIGS. 8*a* and 8*b*. FIG. 8*a* shows schematically a portion of a centrifugal separator including a base plate and FIG. 8*b* shows an enlargement of the cut view of the heavy phase liquid discharge element described above, and also shown in FIG. 5*b*.

The centrifugal separator comprises a rotating body 101 comprising a bowl 102 and a screw conveyor 103 which are mounted on a shaft 104 such that they in use can be brought to rotate around a horizontal axis 105 of rotation. The axis 105 of rotation extends in a longitudinal direction of the bowl 102. Further, the rotating body 101 has a radial direction 105*a* extending perpendicular to the longitudinal direction of the bowl 102. The bowl 102 comprises a base plate 106 provided at one end of the bowl 102. The base plate 106 has an internal side 107 and an external side 108. The base plate 106 is provided with one or more second, heavy liquid phase, outlet passages 145 and one or more first, light liquid phase, outlet passages 115. According to the present disclosure, the first and second liquid phase outlet passage are configured to discharge liquid from the rotating body, wherein the second liquid phase outlet passages 145 are associated with the heavy phase liquid discharge element 200 as described above. By "associated with" is meant that the parts are joined together in a working relationship, and may thus be for example directly or indirectly connected together.

Figure 1:
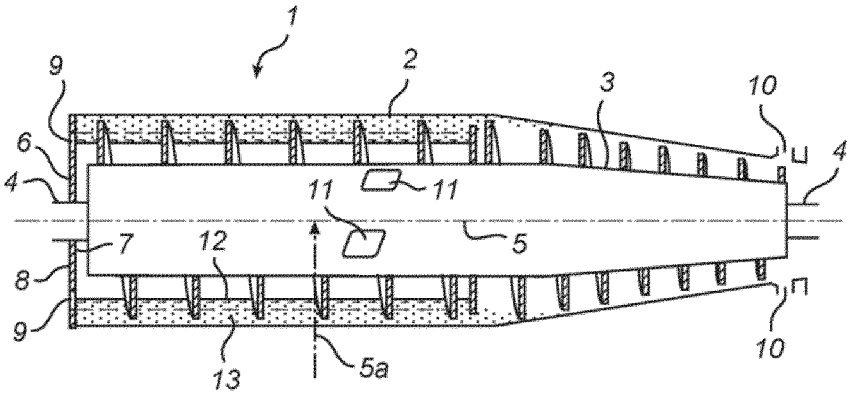
PRIOR ART Fig. 1
FIG. 1 shows schematically a partially cut view of an example prior art centrifugal separator.
Figure 2:
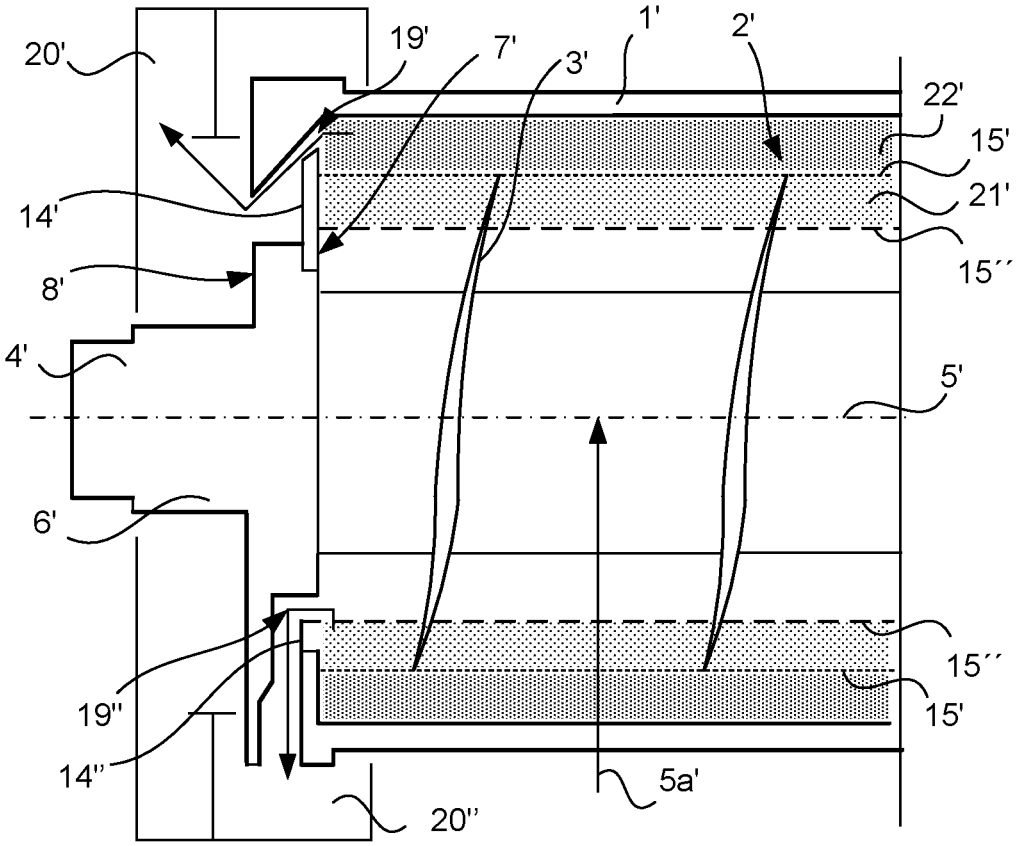
PRIOR ART Fig. 2
FIG. 2 shows schematically a cut view of an end portion of an example prior art centrifugal separator.

Furthermore the bowl 102 is at an end opposite to the base plate 106 provided with solid phase discharge openings (not shown) in a similar manner as described in connection with the prior art separator shown in FIG. 1. Additionally, the screw conveyor 103 shown in FIG. 8*a* may comprise inlet openings (not shown) for feeding a feed slurry to the rotating body 101. The slurry comprises a solid phase (not shown), light liquid phase 21 and a heavy liquid phase 22, with a liquid interface 15' there between. By light liquid phase is meant a liquid phase having a smaller density than the density of the heavy liquid phase. The light phase liquid level is depicted with reference sign 15". Analogously, by heavy liquid phase is meant a liquid phase having a higher density than the density of the light liquid phase. The heavy phase liquid level corresponds to the liquid interface 15' in the shown example. The light liquid phase may be for example an oil or an organic solvent and the heavy liquid phase may be water, but the liquids are not limited thereto.

During rotation of the rotating body 101, separation of the liquid phases 21 and 22 and the solids are obtained. The light liquid phase 21 is located radially closer to the rotation axis 105 than the heavier liquid phase 22 in the radial direction 105*a*. The light liquid phase 21 is discharged through the one or more first liquid phase outlet passages 115 in the base plate 106 to an outlet chamber 121. The heavy liquid phase 22 is discharged through the second outlet passages 145 to an outlet chamber 122, while the screw conveyor 103 transports the solid phase towards the solid phase discharge openings at the opposite end of the separator as described in connection with FIG. 1. Each first liquid phase outlet passage 115 may be partly covered by a respective weir or dam plate 114, or a light phase liquid discharge element 300 (see FIG. 9) comprising an opening passage 315, which may define or be a part of a weir edge in fluid connection with the first outlet passage 115, and being comprised in the base plate 106. Each of the second, heavy, liquid phase outlets 145 is associated with the heavy phase liquid discharge element 200 as described above, which may define an intake level for the heavy phase liquid. In this way it is possible to discharge the respective liquid phases.

Figure 9:
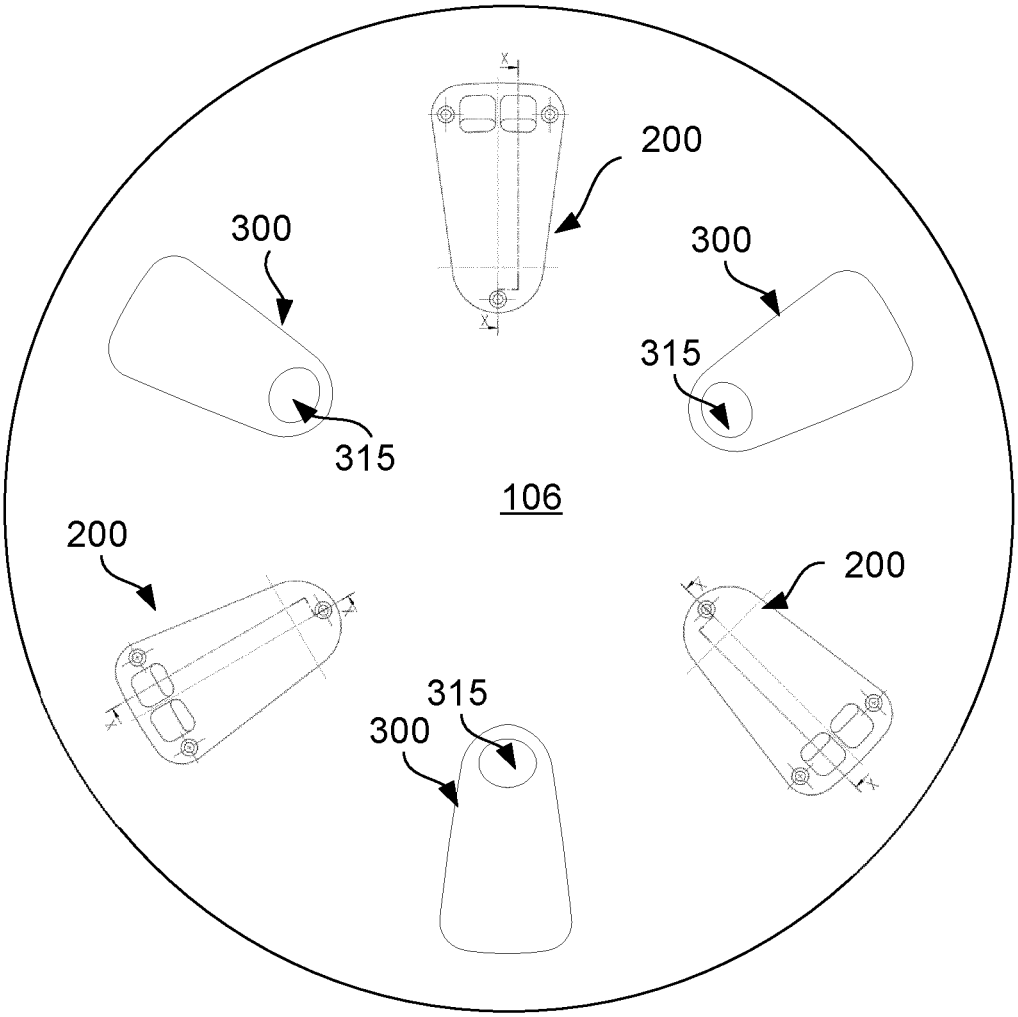
FIG. 9 shows a view of a centrifuge base plate from an inner surface, the base plate comprising the liquid discharge element of the present disclosure.

Reference is now made to FIG. 9, which schematically shows an example of a base plate 106 in a centrifugal separator, viewed from the internal side 107. It can be seen that the base plate 106 is associated with three light phase liquid discharge elements 300, each comprising an opening passage 315 in fluid connection with a first outlet passage (not shown) associated with the base plate. Additionally, the base plate 106 is associated with three heavy phase liquid discharge elements 200, each comprising an opening passage two inlet openings 211, 212 in fluid connection with a second outlet passage (not shown) associated with the base plate. Further, the light phase liquid discharge elements 300 and the heavy phase liquid discharge elements 200 are arranged at different angular positions relative to the axis of rotation, and thus at a distance from each other. The center line (CL) of each of the liquid discharge elements is arranged in the radial direction of the base plate 106. The base plate may comprise pockets or similar means in which the liquid discharge elements 200, 300 can be fitted and secured. In the shown example, every other liquid discharge element is a heavy phase liquid discharge element 200, and every other is a light phase liquid discharge element 300. However, the liquid discharge elements can be arranged in any other way, and the amount of the liquid discharge elements for the heavy phase and light phase, respectively, do not need to be the same. Therefore, the liquid discharge elements preferably have the same outer shape, so that the amount of the respective heavy phase/light phase liquid discharge element can be easily varied. By varying the amount of the respective liquid discharge elements and the arrangement thereof, the liquid removal without pressure losses, respectively, can be adapted to the slurry to be separated. This means that the amount of the heavy phase liquid discharge elements 200 may be larger, if for example water-content is higher than oil content in an oily slurry. Generally, the amount of the light phase liquid discharge elements 300 and the heavy phase liquid discharge elements 200 may vary for example from 2 to 16, and the amount may be equal. Alternatively, the amount of the light phase liquid discharge elements 300 and the heavy phase liquid discharge elements 200 may vary from 2 to 16, but the amount of the heavy phase liquid discharge elements 200 is larger than the amount of the light phase liquid discharge element 300. In this way, the heavy phase may be removed with less pressure losses from the bowl. Alternatively, the amount of the light phase liquid discharge elements 300 is larger than the amount of the heavy phase liquid discharge elements 200. In this way, the light phase may be removed more efficiently from the bowl.

Figure 10:
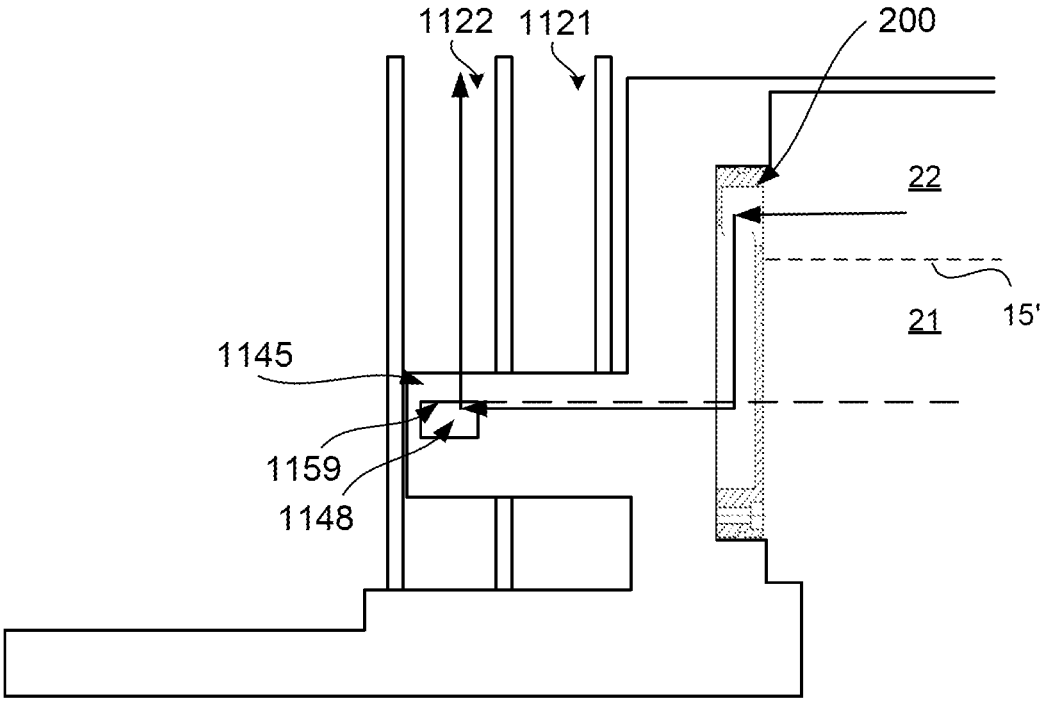
FIGS. 10 and 11, respectively, shows schematically a partially cut view of an example centrifugal separator comprising an outlet housing according to the present disclosure.
Figure 11:
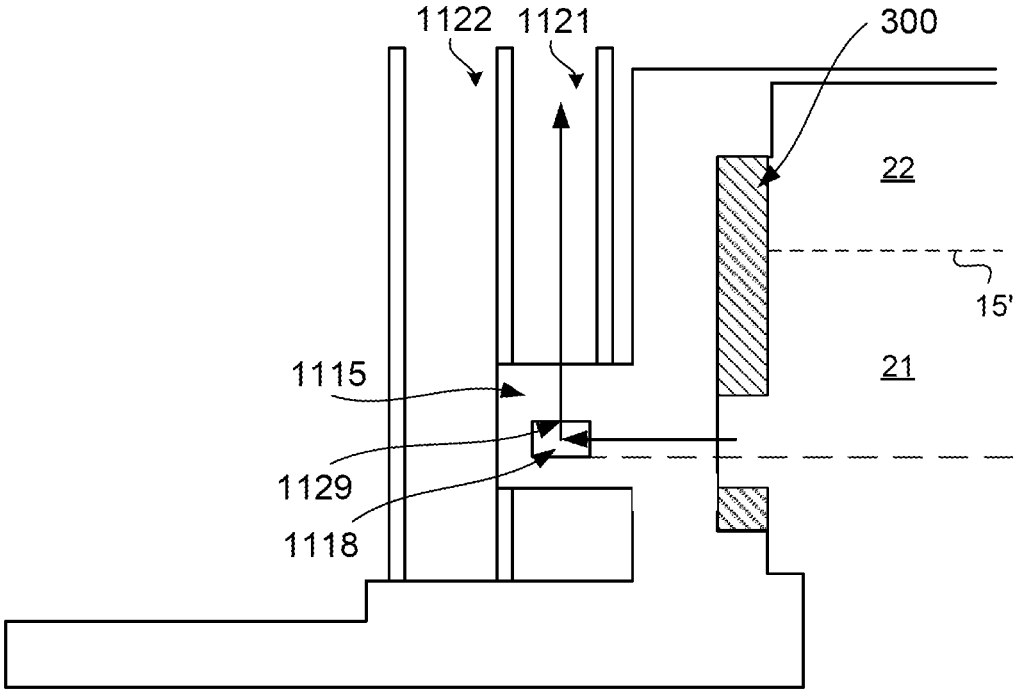

Reference is now further made to FIG. 10 and FIG. 11, which show a further variant of a centrifugal separator base plate 106 with the heavy phase and light phase liquid discharge elements 200 and 300 as described above. The function of the centrifugal separator is the same as described in connection with FIG. 8*a* and the base plate 106 may have the same features as described in connection with FIG. 9, and reference is made thereto. However, the embodiment shown in FIGS. 10 and 11, includes another type of outlet arrangement for the outlet passages 115 and 145 than described above. The light phase liquid discharge element 300 displayed in FIG. 11 is associated with an outlet housing 1115, which is also referred to as a "power tube", and the heavy phase liquid discharge element 200 is associated with a respective outlet housing 1145. The heavy phase 22 is discharged through the outlet housing 1145 to a respective outlet compartment 1122. The light phase 21 is discharged through the outlet housing 1115 to a respective outlet compartment 1121. A liquid interface 15' is shown in between the light and heavy liquid phases. Outlet housings of this type are previously described in WO 2012/062337. However, it has been noted that the heavy phase (second) liquid discharge element 200 of the present disclosure is also usable in connection with such outlet housing arrangements. Each of the outlet housings 1115 and 1145 comprises a respective outlet opening 1118, 1148, through which the respective liquid is discharged. The first outlet opening comprises first weir edge 1129, and the second outlet opening 1148 comprises a second weir edge 1159. The outlet housings 1115 and 1145 can be rotatably adjustable around an adjustment axis, whereby the weir edges can be brought to a desired level in a simple manner. Also, discharge of the liquid phase can be made in an opposite direction relative to the direction of rotation whereby energy can be recovered from the discharged liquid. Thus, more accurate separation can be provided and unnecessary losses of the desirable liquid phase can be decreased.

The present invention also relates to a method of separating a first liquid phase and a second liquid phase from a slurry by means of centrifugal forces in a centrifugal separator. As described above, the liquid phases have different densities. The method comprises the steps of:

- bringing the slurry to a rotational movement in a cylindrical bowl and thereby separating the slurry into two liquid phases,
- separating the liquid phases from each other by
  - bringing the first light liquid phase in fluid contact with at least one first outlet passage comprised in a base plate of the centrifugal separator, the first outlet passage being connected to a weir plate adapted for keeping at least part of the second, heavy phase inside the rotating bowl, wherein the at least one outlet passage provides a liquid pathway to the light phase to be discharged from the bowl
  - bringing the second heavy liquid phase in contact with at least one second outlet passage comprised in a base plate of the centrifugal separator, the second outlet passage being associated with a heavy phase liquid discharge element adapted for keeping at least part of the first light liquid phase inside the rotating bowl, wherein heavy phase liquid discharge element provides a liquid pathway to the heavy phase to be discharged from the bowl, wherein the method is characterized by discharging the heavy phase by using at least two separate liquid outlet channels in the heavy phase liquid discharge element through which the heavy phase liquid is arranged to flow.

By having the two outlet channels in the liquid discharge element, it is possible to decrease pressure losses during the separation process. In this way, it is possible to minimize the losses of a desirable liquid phase and obtain a stable separation process with a stable liquid interface.

Figure 12:
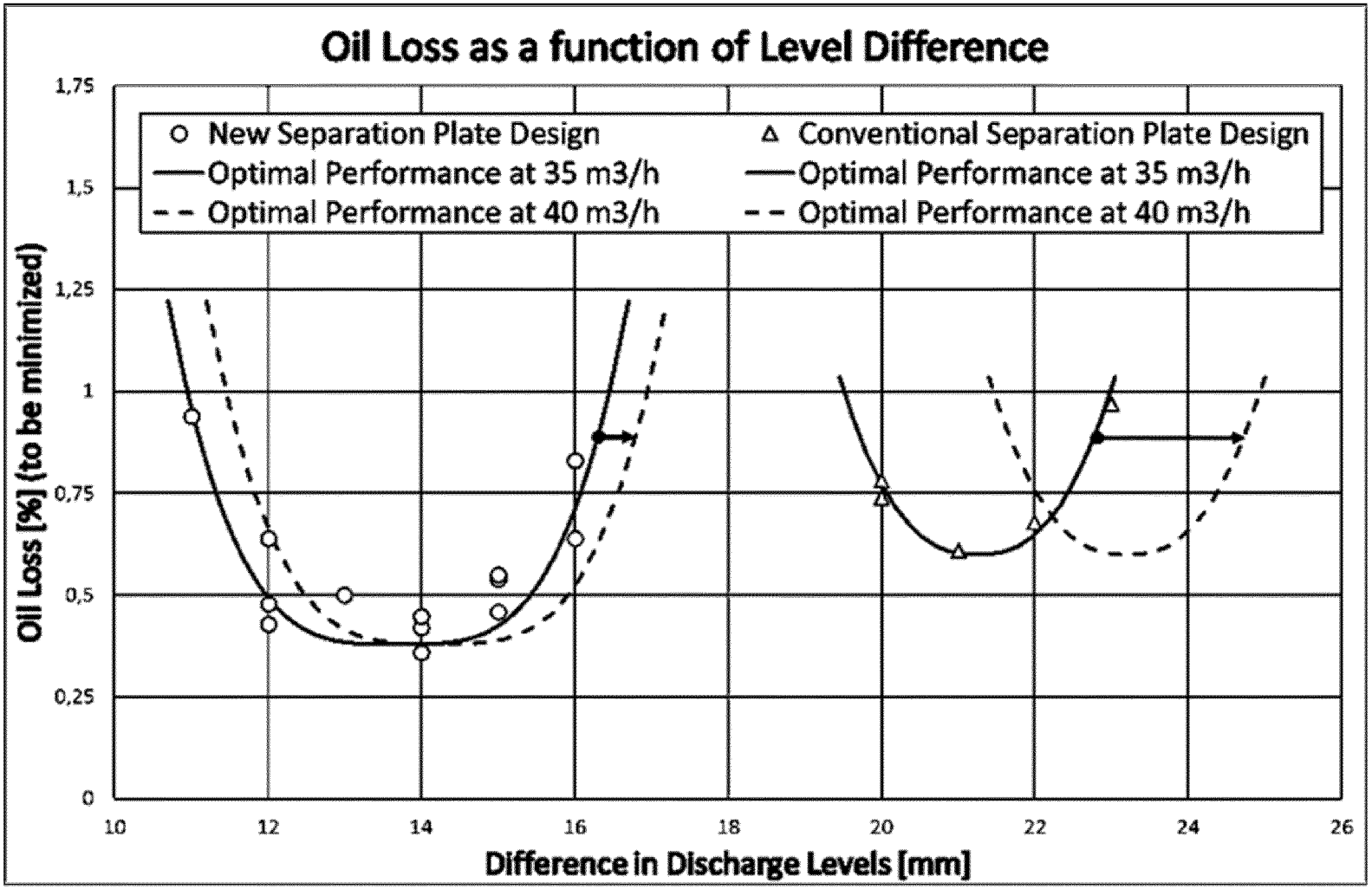
FIG. 12 shows comparative test results relating to oil losses.

FIG. 12 shows results from an experiment in which the heavy phase liquid discharge element of the present invention ("New Separation Plate design") was compared with a prior art liquid discharge element ("Conventional Separation Plate Design"), similar to "the second channel member 167" disclosed by WO2012062337. In the test, a decanter centrifuge with a diameter of 500 mm was operated at 2800 rpm bowl speed on a 3-phase process, where the goal was to minimize the content of light phase (oil) in the discharged heavy phase liquid. This oil loss will depend on the choice of weir radius for the liquids and in particular the difference between the weir levels. On the right side of the graph in FIG. 12 the solid line represents the optimal performance at a feed flow rate of 35 $m^3$/h based on the test results marked by triangles. If an oil loss level of 0.75% is taken as the limit, the difference in discharge levels must be between 20 and 22 mm, which is a quite narrow range. As indicated with the interrupted line the optimal operating window for the discharge level will change to the interval 22 to 24 mm for a flow rate of 40 $m^3$/h indicating that the pressure loss in the heavy phase discharge line increases significantly at increased flow rate. In order to get acceptable performance at 40 $m^3$/h the discharge level setting would need to be adjusted. The test result for the present invention are shown in the left part of the graph, where the solid line based on the test results marked by circles indicates the optimal performance for this design. It is noted that there is a wider operational window covering differences in discharge levels from 11 to 16 mm. Comparing to the original design the change in level difference is equivalent to approximately 1 bar of reduced pressure loss in the discharge line for the heavy phase liquid. The reduced dependency of pressure loss is also noted by the significantly reduced change of operational window when the flow is changed from 35 to 40 $m^3$/h. The new window of 12 to 17 mm difference in discharge level will normally not require a change of level settings for the higher flow rate. This reduces the dependency of flow rate significantly and results in a much more stable interface position even for large flow variations.

The foregoing description of the embodiments has been provided for illustration of the present invention. The embodiments are not intended to limit the scope of the invention defined in the appended claims and features from the embodiments may be combined with one another.

The invention claimed is:

1. A heavy phase liquid discharge element for a centrifugal separator configured to separate two liquid phases having different densities, the heavy phase liquid discharge element having a longitudinal extension, a transversal extension perpendicular to the longitudinal extension, a first inlet side and an opposite second outlet side, both extending in the longitudinal direction and in the transversal direction, a first longitudinal portion comprising a first transversally extending edge, a second longitudinal portion comprising a second transversally extending edge, and two longitudinally extending side edges, in between which a longitudinally extending center line extends, the heavy phase liquid discharge element comprising:

at least one inlet opening on the first side of the heavy phase liquid discharge element, the at least one inlet opening being adapted to face an interior of the centrifugal separator, and at least two separate outlet channels defining an outlet on the second side of the heavy phase liquid discharge element, wherein at least a portion of each of the outlet channels overlaps with the at least one inlet opening, thereby forming a liquid pathway between the at least one inlet opening and the outlet defined by the at least two outlet channels through which a liquid can pass, and each of the at least two outlet channels having an extension in the longitudinal direction of the heavy phase liquid discharge element, which is longer than the extension of the at least one inlet opening in the longitudinal direction.

2. The heavy phase liquid discharge element of claim 1, wherein the at least two outlet channels are arranged in parallel along the longitudinal extension of the heavy phase liquid discharge element, and the at least two outlet channels are positioned symmetrically and mirror-imaged in respect to the center line.

3. The heavy phase liquid discharge element of claim 2, wherein the at least two outlet channels extend in the first and second longitudinal portions.

4. The heavy phase liquid discharge element of claim 1, wherein the at least two outlet channels extend in the first and second longitudinal portions.

5. The heavy phase liquid discharge element of claim 1, wherein the number of the outlet channels is from 2 to 6.

6. The heavy phase liquid discharge element of claim 1, wherein two outlet channels of the at least two outlet channels have respective channel end portions which taper symmetrically and in a mirror-imaged way towards the center line and the second transversally extending edge in the second longitudinal portion and wherein the tapering end portions have a rounded shape.

7. The heavy phase liquid discharge element of claim 1, wherein the at least one inlet opening is comprised in the first longitudinal portion.

8. The heavy phase liquid discharge element of claim 1, wherein the amount of the inlet openings correspond to the amount of the outlet channels.

9. The heavy phase liquid discharge element of claim 1, wherein the at least one inlet opening comprises a first transversally extending inlet edge on the first inlet side towards the first transversal edge of the liquid discharge element and each of the outlet channels comprises a first transversally extending outlet edge on the second outlet side towards the first transversal edge of the liquid discharge element, wherein a longitudinal distance between the first transversal inlet edge and the first transversal edge of the liquid discharge element is smaller than a longitudinal distance between the first transversally extending outlet edge and the first transversally extending edge of the liquid discharge element.

10. The heavy phase liquid discharge element according to claim 9, wherein an extension of the first transversal inlet edge in a plane of a thickness dimension is perpendicular to the central line and to a peripheral wall.

11. A centrifugal separator configured to separate a first liquid phase, a second liquid phase and a solid phase from a slurry, wherein the liquid phases have different densities, the centrifugal separator comprising a rotating body comprising a bowl, the bowl comprising a base plate at an end of the bowl, the base plate having an inner surface and an opposite outer surface, the inner surface facing an interior of the bowl, the base plate comprising one or more first liquid phase outlet passages and one or more second liquid phase outlet passages, the first and second liquid phase outlet passages being configured to discharge liquid from the rotating body, wherein the second liquid phase outlet passages are associated with the heavy phase liquid discharge element of claim 1.

12. The centrifugal separator of claim 11, wherein the one or more first liquid phase outlet passages are configured to discharge the first liquid phase, which is lighter than the second liquid phase.

13. Centrifugal separator of claim 12, wherein the one or more first liquid phase outlet passages comprises a light phase liquid discharge element comprising an opening passage in fluid connection with the first outlet passage comprised in the base plate.

14. The centrifugal separator of claim 13, wherein the light phase liquid discharge elements and the heavy phase liquid discharge elements are arranged in association with the inner surface of the base plate and at different angular positions relative to an axis of rotation.

15. The centrifugal separator of claim 13, wherein the amount of the light phase liquid discharge element and the heavy phase liquid discharge element varies from 2 to 16, and wherein the amount is equal.

16. The centrifugal separator of claim 13, wherein the amount of the light phase liquid discharge element and the heavy phase liquid discharge element varies from 2 to 16, and wherein the amount of the heavy phase liquid discharge elements is larger or smaller than the amount of the light phase liquid discharge element.

17. The centrifugal separator of claim 13, wherein the light phase liquid discharge element and the heavy phase liquid discharge element are associated with a respective outlet housing, wherein each of the respective outlet housings is rotatably adjustable around an adjustment axis, and each of the respective outlet housings comprises a respective outlet opening comprising a respective weir edge.

18. The centrifugal separator of claim 13, wherein the amount of the light phase liquid discharge element and the heavy phase liquid discharge element varies from 2 to 16, and wherein the amount is equal.

19. The centrifugal separator of claim 13, wherein the amount of the light phase liquid discharge element and the heavy phase liquid discharge element varies from 2 to 16, and wherein the amount of the heavy phase liquid discharge elements is larger or smaller than the amount of the light phase liquid discharge element.

20. A method of separating a light liquid phase and a heavy liquid phase from a slurry by centrifugal forces in a centrifugal separator comprising a heavy phase liquid discharge element, wherein the liquid phases have different densities, the method comprising bringing the slurry to a rotational movement in a cylindrical bowl and thereby separating the slurry into two liquid phases, separating the light liquid phase and heavy liquid phase from each other by bringing the light liquid phase in fluid contact with at least one first outlet passage comprised in a base plate of the centrifugal separator, the first outlet passage being connected to a weir plate adapted for keeping at least part of the heavy phase inside the rotating bowl, wherein the at least one first outlet passage provides a liquid pathway to the light phase to be discharged from the bowl bringing the heavy phase in contact with at least one second outlet passage on a second side of the heavy liquid discharge element through an at least one inlet opening on a first side of the heavy phase liquid discharge element, the at least one inlet opening facing an interior of the centrifugal separator and formed in the base plate of the centrifugal separator, the heavy phase liquid discharge element being adapted for keeping the light phase inside the rotating bowl and for providing a liquid pathway to the heavy phase to be discharged from the bowl, the liquid pathway being formed between the at least one inlet opening and the at least one second outlet passage, wherein the at least one second outlet passage is defined by at least two outlet channels through which liquid can pass, wherein the discharging the heavy phase uses the at least two separate outlet channels connected to a respective at least one second outlet passage, wherein at least a portion of each of the outlet channels overlaps with the at least one inlet opening, wherein the at least two outlet channels have an extension in the longitudinal direction of the heavy phase liquid discharge element which is longer than the extension of the at least one inlet opening in the longitudinal direction.

* * * * *